United States Patent [19]

Bullock

[11] Patent Number: 4,678,094

[45] Date of Patent: Jul. 7, 1987

[54] TAMPER-RESISTANT CONTAINER CAP

[75] Inventor: Joseph J. Bullock, Atherton, Calif.

[73] Assignee: Bankers Trust Co., New York, N.Y.

[21] Appl. No.: 857,197

[22] Filed: Apr. 29, 1986

[51] Int. Cl.[4] ..... B65D 41/48

[52] U.S. Cl. ..... 215/256

[58] Field of Search ..... 215/256, 305, 232; 220/359

[56] References Cited

U.S. PATENT DOCUMENTS

| | | | |
|---|---|---|---|
| 3,142,403 | 7/1964 | Fox | 215/256 |
| 3,861,549 | 1/1975 | Watson et al. | 215/232 |
| 4,166,552 | 9/1979 | Faulstich | 215/256 |
| 4,328,905 | 5/1982 | Hardt | 220/359 X |

*Primary Examiner*—Donald F. Norton

*Attorney, Agent, or Firm*—Julian Caplan

[57] ABSTRACT

A cap for a container neck has a skirt formed with beads on its inner surface which cooperate with matching grooves in the neck to retain the cap in place when the skirt is intact. A circumferential groove is formed in the skirt intermediate the beads joined with a second groove extending to the bottom edge of the skirt. A tab projecting beyond the skirt is gripped and pulled, causing the skirt to tear upward and then circumferentially, thereby removing the lower bead and permitting the top of the cap to be removed and re-closed. A flange is formed on the exterior of the skirt immediately above the level of the first groove. The flange prevents the skirt from tearing upward above the first groove. It also facilitates prying the cap off the neck when the lower part of the skirt has been torn off. Various flange shapes are disclosed, several of which are shaped to defeat attempts to pry off the cap before the skirt is torn. A flange which has a groove formed in its bottom surface adjacent the skirt is particularly tamper-resistant, as is a flange wherein the top and bottom surfaces converge outwardly. The cap beads may be continuous or interrupted. The cap may be provided with an inner skirt or plug to fit into the neck of the container.

17 Claims, 14 Drawing Figures

TAMPER-RESISTANT CONTAINER CAP

BACKGROUND OF THE INVENTION

1. Field of the Invention

This invention relates to a new and improved flexible plastic tamper-resistant closure for containers of the type in which the bottom of the cap skirt is torn off before the container may be opened. The invention is characterized by the formation on the exterior of the skirt of a flange intended to assist in removing the cap after the bottom of the skirt has been torn away, which flange is located spaced downwardly from the top of the cap and preferably at a level immediately above the circumferential groove formed in the cap to assist in tearing the skirt.

2. Description of Related Art

Caps having skirts formed with internal beads to mate with grooves in container necks are illustrated in U.S. Pat. No. 3,338,446 and in other patents of the assignee of this application. Such a cap has been formed with a circumferential groove intermediate the beads connected to a groove extending down to the bottom edge of the skirt. Tear tabs positioned adjacent the second mentioned groove are also disclosed in the aforementioned patents. Interrupted beads are shown in such patents as U.S. Pat. No. 4,166,552.

It has been found, however, that users sometimes tear the skirts with such force that instead of the skirt being torn circumferentially around the first mentioned groove, the skirt is torn upwardly to or adjacent the top disk of the cap. Various means have been used in the prior art to prevent such tearing. The present invention provides a novel means to resist such tearing.

After the lower part of the skirt has been torn away, various means have been used to assist the user in removing the upper portion of the cap each time the contents of the container are to be dispensed. The use of a flange around the outside of the skirt is shown in U.S. Pat. No. 3,927,784. Since such a flange may be used by dishonest patrons to pry off the cap without tearing away the bottom of the skirt and hence avoids providing evidence of tampering, flange constructions to defeat such purpose have been used. Thus a flexible flange is shown in U.S. Pat. No. 4,166,552, so that when the patron attempts to pull upward on the flange it flexes and cannot be gripped securely to tamper with the cap. A flange having a downward-inward slanted surface such as shown in U.S. Pat. No. 4,484,687 has been used, the slanted bottom edge preventing the fingernails of the user from digging under the flange and hence defeating attempts to tamper.

Flanges of the foregoing type have been located at the outside of the top of the outer skirt of the cap. In accordance with the present invention, such flanges are at a lower level.

SUMMARY OF THE INVENTION

Accordingly, the present invention provides a cap for a container neck wherein a flange around the outside of the skirt is located spaced downward from the top of the skirt and located at a level slightly above the level of the circumferential groove in the skirt around which the cap is torn preliminary to first opening the container. The flange of the present invention serves its primary purpose of assisting the user in removing the upper portion of the cap after the lower portion of the skirt has been torn away. It also is so constructed as to defeat attempts of dishonest patrons to pry off the cap without first tearing the bottom of the skirt and thereby furnishing evidence of tampering. In addition, the flange, being located immediately above the circumferential groove, provides a thickening of the wall of the skirt, which prevents the user from inadvertently tearing the upper portion of the skirt rather than tearing around the circumferential groove.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
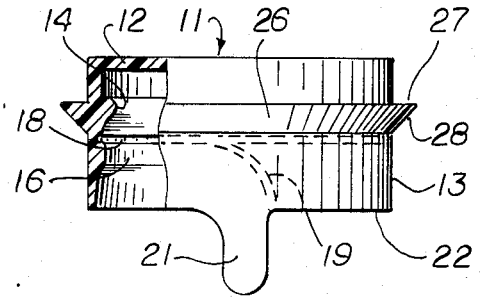
FIG. 1 is a side elevational view of a cap in accordance with the present invention partially torn away to reveal internal construction.

Directing attention now to FIG. 1, cap 11 is formed of an injection molded plastic material which will stretch sufficiently so that the cap may be seated on the neck of a container (not shown). Cap 11 has a top disk 12 which seats on the top edge of the neck. From the periphery of disk 12 depends skirt 13. Top bead 14 is formed on the interior of skirt 13 and below bead 14 is lower bead 16. Beads 14 and 16 seat in grooves in the container neck and when thus seated, cap 11 cannot be removed without evidence of tampering appearing.

Intermediate beads 14 and 16 is a circumferential groove 18 here shown as formed on the inside of skirt 13. It will be understood that the groove 18 might be formed on the outside. Extending downward from groove 18 is a second groove 19 which curves down to the bottom edge 22 of skirt 13. Immediately adjacent the intersection of groove 19 and bottom edge 22 is a tab 21 which depends from the skirt and may be gripped by the user. To facilitate such gripping, transverse ribs 23 (see FIG. 6) may be formed in tab 21, preferably on the under side thereof. When the user grips tab 21 and pulls upward, the skirt 13 tears first along the groove 19 and then around the groove 18 so that the entire portion of the cap below groove 18 may be removed. It has been found in prior constructions, however, that sometimes the user pulls upward on the tab 21 so forcefully or there is a defect in the molding of the skirt so that instead of tearing around the groove 18 the continued pulling on the tab 21 causes the skirt to tear up to the disk 12. Such mishaps make it difficult to remove the cap from the container and make it virtually impossible to use the upper part of the cap as a reclosure cap.

To facilitate removal of the reclosure cap (i.e., the portion of the cap which remains after the skirt has been torn around the groove 18), a flange 26 is formed on the exterior of the skirt 13. As illustrated in cap of FIG. 1 and the other modified caps hereinafter described, the level of flange 26 is immediately above the level of groove 18. This provides a thickening of the cap occasioned by bead 14 and flange 26 and effectively prevents the user from tearing the skirt 13 up to the disk 12.

The purpose of flange 26 is to assist the user in prying the cap off the container neck. It has been found, however, that some dishonest patrons use the flanges of the prior art to pry off the cap and to remove the contents of the container without tearing away the bottom of the skirt 13. The flange 26 of FIG. 1 shows one means of deterring such dishonest patrons. Thus flange 26 has a horizontal top surface 27 and a downward-inward slanted surface 28. It is very difficult for the fingernails of the user to grip under the surface 28 to pull the cap 11 off the neck.

Figure 2:
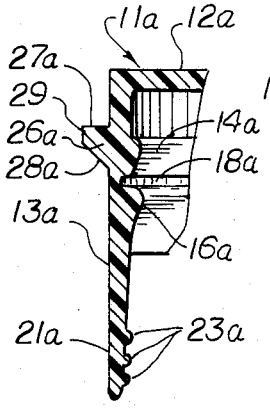
FIG. 2 is a vertical sectional view through a cap modified from the structure of FIG. 1.

In FIG. 2, flange **26*a* is very similar to the flange 26 of FIG. 1 except that the outer edge 29** of the triangular cross-section thereof is blunted or truncated.

Figure 3:
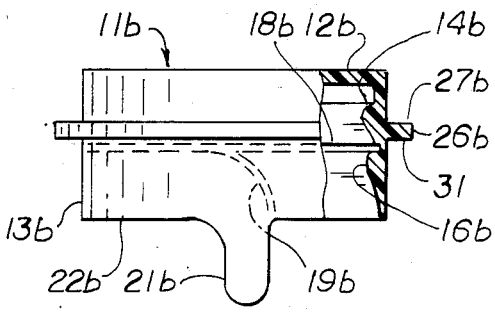
FIG. 3 is a view similar to FIG. 1 of a further modified cap.
Figure 4:
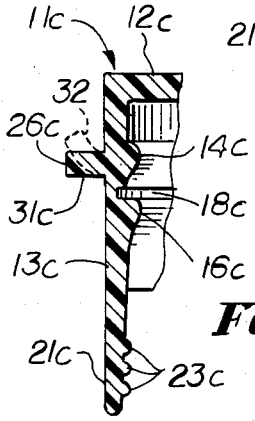
FIG. 4 is a view similar to FIG. 2 of still another modification.

In FIG. 3, the bottom surface 31 of flange **26*b* is horizontal and generally parallel to the top surface 27*b*. Such a flange has been found to be less satisfactory than that shown in FIGS. 1 and 2. Accordingly, the flange 26*c* shown in FIG. 4 may be made flexible, the flange bending upwardly as indicated by reference numerals 32 if one attempts to use it to pry off the cap 11*c*. If the material of construction of the cap 11*c* is sufficiently frangible, when the tab 26*c* bends up to the position shown by reference numeral 32**, further upward prying may cause it to break.

Figure 5:
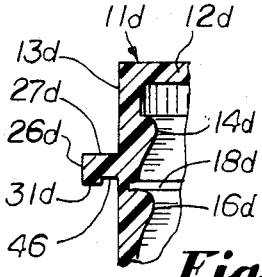
FIGS. 5 to 9 are fragmentary views similar to a portion of FIG. 2 of still further modified flanges.

FIG. 5 shows a modified flange **26*d* having a horizontal top edge 27*d* and bottom edge 31*d*. A circumferential groove 46 is formed extending upward in surface 31*d* adjacent skirt 13*d*. Groove 46 makes flange 26*d*** quite flexible and makes it more difficult for a dishonest customer to use the flange to pry off the cap before the lower part of the skirt has been torn off. The area above the groove may rupture if excessive prying force is used.

Figure 6:
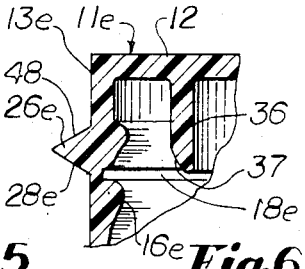

FIG. 6 shows modified flange **26*e* wherein top surface 48 slants downward-outward and bottom surface 28*e*** slants upward-outward. Again, this construction makes the cap quite tamper-resistant, since it is difficult to use the flange to pry off the cap before the bottom of the skirt has been torn away.

Figure 7:
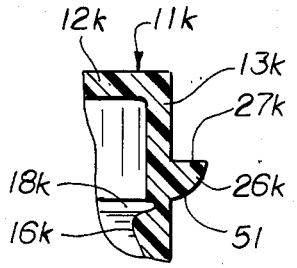

FIG. 7 shows flange **26*k* having a quarter-round shape in that the top surface 27*k* is flat while the bottom surface 51** is arcuate.

Figure 8:
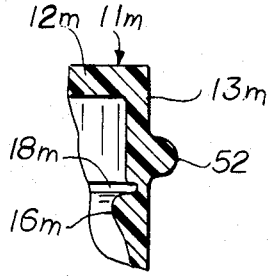

FIG. 8 shows half-round flange 52. In cross-section it is approximately semi-circular.

Figure 9:
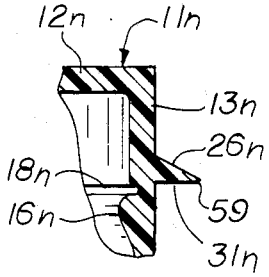

FIG. 9 shows a flange **26*n* which has a downward sloping top-surface 59 and a substantially horizontal surface 31*n***.

It will be noted that the modifications of FIGS. 7–9 show no upper bead corresponding to bead 12 of FIG. 1. Where secure retention of the reclosure cap (which is formed by removal of the skirt below tear line 18) is not a problem—e.g., one-portion beverage bottles—such upper bead may be eliminated. The upper bead may be eliminated in the other modifications heretofore and hereinafter described.

Figure 10:
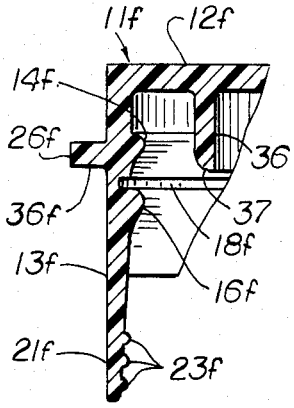
FIG. 10 is a view similar to FIG. 2 of a cap having an inner skirt, it being understood that an inner skirt may be used in any of the preceding modifications.

FIG. 10 shows a cap **11*f* provided with an inner skirt or plug 36 which fits inside the neck of the container (not shown). To facilitate seating of the cap, the outer bottom edge 37 of inner skirt or plug 36 is beveled. It will be understood that the inner skirt 36 shown in FIG. 10 may be used in any of the other modifications illustrated (except FIG. 14**, hereinafter described).

Figure 11:
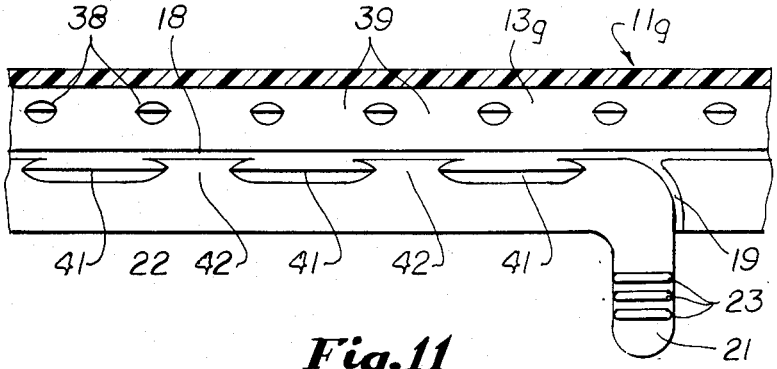
FIG. 11 is a schematic view showing the interior of the skirt of the cap developed in a plane showing interrupted beads, it being understood that such interruptions may be used in any of the structures of FIGS. 1–10.

FIG. 11 shows that the top bead 14 of the cap may be formed with top bead sections 38 separated by top bead interruptions 39. FIG. 11 also illustrates that the bottom bead may be formed with bottom bead sections 41 separated by bottom bead interruptions 42. Either the upper bead or lower bead may be interrupted or both may be interrupted (as shown in FIG. 11). The interruptions of the beads permit the skirt **13*g* to flex so that the bead interruptions snap over the beads on the exterior of the container neck without crushing the neck or causing the skirt 13*g*** to tear.

Figures 12, 13:
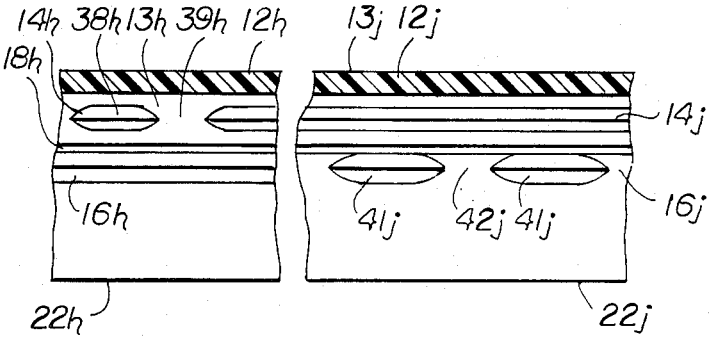
FIG. 12 is a fragmentary view similar to FIG. 11 of an additional modification.
FIG. 13 is a view similar to FIG. 10 of a still additional modification.

FIG. 12 shows that the bottom bead may be continuous while the top bead may be interrupted. In FIG. 12 the bead sections are elongated while the gaps are short. However, it will be understood that short sections 38 similar to sections 38 shown in FIG. 11 may be substituted.

FIG. 13 shows top bead **14*j* continuous and bottom bead 16*j* interrupted in sections 41*j* separated by gaps 42*j*. Again, the bottom bead sections may be short (as sections 38 in FIG. 12) instead of the long sections 41*j*** illustrated.

Figure 14:
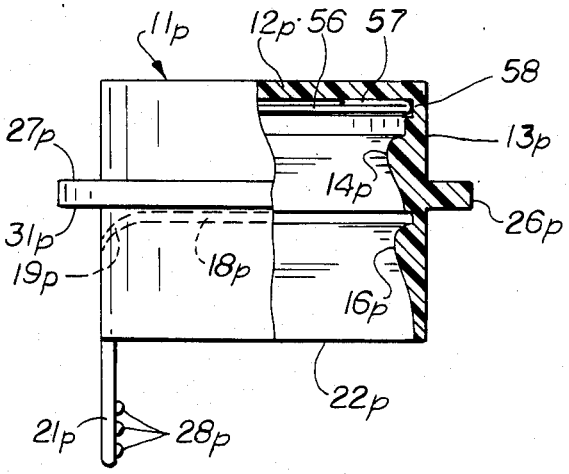
FIG. 14 is a view similar to FIG. 2 of a cap having a foil lining, it being understood that such lining may be used in any of the structures of FIGS. 1–9.

Fig. 14 illustrates a foil lined cap. A foil seal disk 56 having adhesive on its underside is inserted in the cap **11*p*. After the cap is installed on a bottle neck, the adhesive sticks to the neck as tamper-evident protection. An integral tab 57 is folded over disk 56 and is tucked between the foil 56 and the underside of top disk 12*p*. When the cap is removed, the consumer grips tab 57 to remove seal disk 56. To prevent disk 56 being dislodged from the cap prior to the cap being applied to the container, it may be cut slightly oversize. A groove 58 is formed on the inside of skirt 13*p* immediately below top disk 12*p*. The edge of disk 56 snaps into groove 58**.

Foil liners may be used with any of the caps illustrated in FIGS. 1–9. The inner skirt 36 of FIG. 14 inhibits use of a foil liner.

In other respects the caps illustrated in FIGS. 2 to 14, inclusive, are the same as that shown in modification of FIG. 1 and the same reference numerals followed by the subscripts a, b, c, d, e, k, m, n, f, g, h, j and p, respectively, are used to designate corresponding elements.

What is claimed is:

1. A tamper-resistant tearable cap for a container comprising a top disk, a skirt depending from the periphery of said top disk, bead means on the interior of said skirt cooperable with cooperating means on a container neck to secure said cap on said neck while said skirt is intact, score means on said skirt, a tear tab on said skirt adjacent said score means whereby upon pulling said tear tab said skirt may be torn to disengage said bead means from said cooperating means, and a peripheral flange on the exterior of said skirt located substantially below said disk, said score means comprising a horizontal circumferential score line and said flange being located immediately above said circumferential score line, said flange preventing tearing of said skirt above the level of said flange.

2. A cap according to claim 1 in which said flange is located about at the level of said bead means.

3. A cap according to claim 1 in which said bead means comprises upper and lower horizontal internal beads and said score means comprises a horizontal score line intermediate said beads and below said flange, a second score line extending from said horizontal score line to the bottom of said skirt and a tear tab depending from said bottom adjacent said second score line.

4. A cap according to claim 3 in which at least one of said internal bead means is interrupted.

5. A cap according to claim 1 which further comprises a second skirt depending from said disk inside said first-mentioned skirt.

6. A cap according to claim 1 in which said flange is rectangular in cross-section.

7. A cap according to claim 6 in which the underside of said flange is formed with a circumferential groove, the portion of said flange above said groove being flexible.

8. A cap according to claim 6 in which said flange is flexible whereby said flange bends to defeat any attempt to pry the cap upward by means of said flange before said score line is torn.

9. A cap according to claim 1 in which said flange is triangular in cross-section, the underside of said flange slanting downward-inward to about the level of said circumferential score line.

10. A cap according to claim 1 in which said flange is triangular in cross-section, the top of said flange slanting downward-outward.

11. A cap according to claim 1 in which the top surface of said flange slants downward-outward and the bottom surface of said flange slants upward-outward from about the level of said circumferential score line.

12. A cap according to claim 1 in which said flange is quarter-round in cross-section.

13. A cap according to claim 1 in which said flange is half-round in cross-section.

14. A cap according to claim 1 which further comprises a foil disk on the underside of said top disk and adhesive on the underside of said foil disk.

15. A cap according to claim 14 which further comprises a tab extending from the periphery of said foil disk, said tab initially being folded over said foil disk and nested between said foil disk and said top disk.

16. A cap according to claim 14 in which the inside of said skirt is formed with a circumferential groove below said top disk, the margin of said foil disk extending into said groove.

17. A tamper resistant and tearable cap for a container comprising a top disk, a skirt depending from the periphery of said top disk, bead means on the interior of said skirt cooperable with cooperating means on a container neck to secure said cap on said neck while said skirt is intact, score means on said skirt, a tear tab on said skirt adjacent said score means, whereby upon pulling said tear tab said skirt may be torn to disengage said bead means from said cooperating means and a peripheral flange on the exterior of said cap having top and bottom surfaces, said bottom surface being formed with a circumferential groove adjacent said outer skirt, the portion of said flange above said groove being flexible to inhibit use of said flange to remove said cap before said skirt is torn.

* * * * *